United States Patent [19]

Robinson

[11] Patent Number: 4,511,278

[45] Date of Patent: Apr. 16, 1985

[54] CONNECTOR UNIT FOR GEODESIC DOME FRAME STRUT

[75] Inventor: Richard T. Robinson, Riverside, Calif.

[73] Assignee: Delta Engineering Co., Covelo, Calif.

[21] Appl. No.: 471,283

[22] Filed: Mar. 2, 1983

[51] Int. Cl.[3] ..... E04B 1/32

[52] U.S. Cl. ..... 403/172; 52/81; 52/DIG. 10

[58] Field of Search ..... 52/81, 82, 648, DIG. 10; 403/172, 171, 176, 219, 217, 218, 170

[56] References Cited

U.S. PATENT DOCUMENTS

| | | | |
|---|---|---|---|
| 1,133,138 | 3/1915 | Henderson | 52/241 |
| 1,258,410 | 3/1918 | Hill | 52/82 |
| 2,966,708 | 1/1961 | Hreeman | 52/696 |
| 3,333,875 | 8/1967 | Tracy | 52/648 |
| 3,807,101 | 4/1974 | Cole | 52/82 |
| 4,245,809 | 1/1981 | Jackson | 52/81 |
| 4,247,218 | 1/1981 | Jeanin | 52/81 |
| 4,370,073 | 1/1983 | Ohme | 52/81 |
| 4,384,801 | 5/1983 | Hamel | 52/81 |

FOREIGN PATENT DOCUMENTS

| | | | |
|---|---|---|---|
| 125648 | 5/1919 | United Kingdom | 52/82 |

*Primary Examiner*—Henry E. Raduazo

*Attorney, Agent, or Firm*—Limbach, Limbach & Sutton

[57] ABSTRACT

A connector unit for connecting the struts of a geodesic dome framework is disclosed. The connector unit has the general shape of a frustum of a right circular cone. Five equally spaced rectangular depressions are formed in the upper surface of the frustum and a pair of flanges in mirror image relationship in planes perpendicular to the planes of the rectangular depressions are placed on opposite sides of each rectangular depression and each flange of the pair has an opening in its central area with the openings in register with each other.

3 Claims, 6 Drawing Figures

CONNECTOR UNIT FOR GEODESIC DOME FRAME STRUT

TECHNICAL FIELD

The present invention relates to the construction of geodesic domes, in particular to a connector unit for connecting the struts which make up the framework of the geodesic dome.

Structures now commonly referred to as "geodesic domes" were described by Buckminster Fuller in U.S. Pat. No. 2,682,235. The general character of geodesic dome construction and many illustrations of geodesic domes are set out in Robert W. Marks book titled, "The Dymaxion World of Buckminster Fuller", *Southern Illinois University Press* (1960).

In recent years there has been considerable interest and commercial activity in the production of small geodesic dome structures which are suggested for use and actually used as greenhouses, storage sheds, ice fishing huts, cabanas, etc. Geodesic dome kits have been made available for do-it-yourself builders of small geodesic dome structures.

BACKGROUND ART

The framework of the geodesic dome is a network of interconnected struts which are commonly connected to form a framework which appears as a network of triangles so arranged that each side of each triangle abuts a side of an adjacent triangle, the abutting sides being of equal lenth. It is inherent in this network of triangles that each vertex of each triangle meets the vertices of several other triangles. The struts meeting at a common vertex point in the framework must be anchored and various means have been used to accomplish the anchoring. These means range from simply nailing the struts together at the common vertex point to providing connector units which hold the struts together rigidly at the common vertex.

A connector unit for this purpose was developed by Robert C. Liu, an agricultural engineer with the Department of Agriculture and is described in *United States Department of Agriculture Miscellaneous Publications* No. 1211 which was issued in October 1971.

BRIEF DESCRIPTION OF THE INVENTION

The connector unit of the invention has the general shape of a frustum of a right circular cone. The outer surface of the frustum has five equally spaced rectangular depressions in it and they extend between the bases of the frustum, the length sides of the rectangular depressions are parallel to the elements of the frustum. A flange extends outwardly from each side of each rectangular depression and the plane of each flange is perpendicular to the plane of the related rectangular depression. The flanges on opposite sides of each rectangular depression are in mirror image relationship with each other. Each flange has an opening in its central area and the openings in the flanges extending outward from opposite sides of each rectangular depression are in register with each other.

In use of the connector unit a strut is fitted into each rectangular depression in the frustum between the two flanges at the rectangular depression sides. A drill hole penetrates the end of the strut in its central portion and is positioned to be in register with the two openings in the flanges. A bolt is passed through the flanges and the strut and the strut is fastened by tightening a nut on the bolt end.

DETAILED DESCRIPTION OF THE INVENTION

The connector unit of the invention will be described in detail by reference to the appended drawings.

Figure 1:
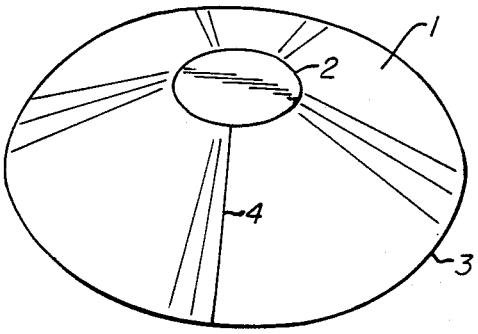
FIG. 1 simply shows the frustum of the cone before the rectangular depressions are made in it.

FIG. 1 is simply a view of the frustum of the cone which is the basic part of the connector unit before details of the structure are added. Frustum 1 is a frustum of a right circular cone having a top base 2 and a bottom base 3. The diameter of the bottom base is four to five times the diameter of the top base. Line 4 shows an element of the frustum of the cone and the angle of the element with the vertical is about 67°.

Figure 2:
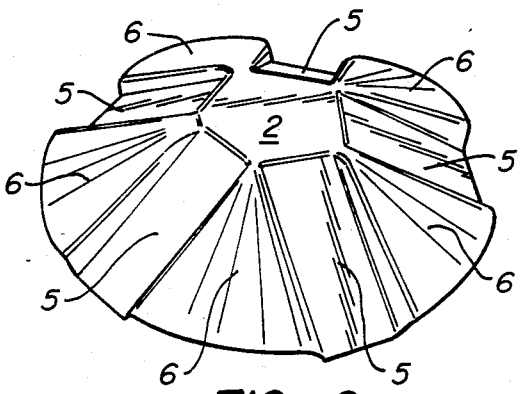
FIG. 2 is a view of the frustum from above after the rectangular depressions have been made in the frustum surface.

FIG. 2 is the frustum shown in FIG. 1 but with the rectangular depressions shown in the outer surface. Rectangular depressions 5 are equally spaced around the circumference of the frustum and five triangular areas 6 lie between the rectangular depressions. The length sides of the triangular depressions are parallel to the element of the frustum lying in the approximate middle of the rectangular depression.

Figure 3:
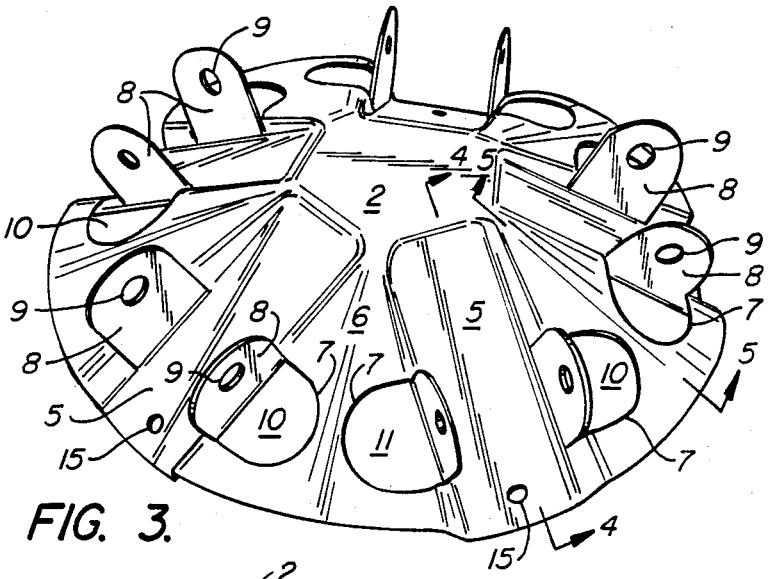
FIG. 3 is a view from above of the connector unit in its finished form ready for use.

FIG. 3 is a view of the connector unit in finished form ready for use.

Rectangular depressions 5 and triangular areas 6 are as described in reference to FIG. 2.

The triangular areas are cut through along lines 7 and the portions of the triangular area freed by cut 7 are bent vertically upward until they are in planes perpendicular to the planes of the rectangular depressions and form flanges 8 between which the struts will lie when they are attached. The flanges are in mirror image relationship to each other. An opening 9 is made in each flange. Openings 9 in each pair of opposing flanges are in register with each other and are adapted to receive a bolt which passes through both flanges and through a hole suitably placed in the strut to receive the bolt. Openings 10 outlined by line 7 remain in the triangular areas after flanges 8 have been bent into position.

Figure 4:
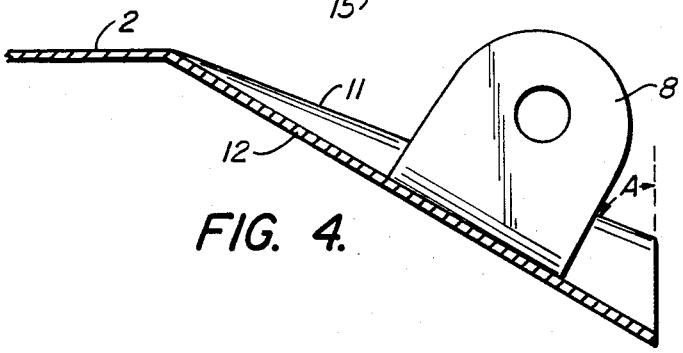
FIG. 4 is a sectional view taken along line 4—4 of FIG. 3.

In FIG. 4 of the drawings the flange 8 is shown resting on the base of the rectangular base 12 of a rectangular depression which lies below the surface 11 of triangular area 5. Angle A, which is the angle between the plane of triangle areas 5 and the vertical is very nearly 67°.

Figure 5:
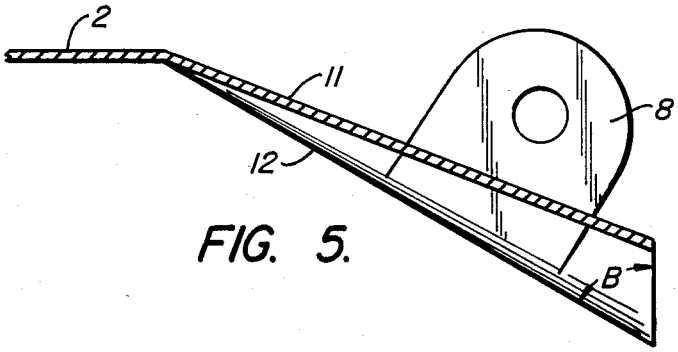
FIG. 5 is a sectional view of the connector unit taken along the line 5—5 of FIG. 3.

In FIG. 5 which is a section along lines 5—5 of FIG. 3, flange 8 rests again on the bottom 12 of the rectangular depression and rises above the surface 11 of triangular area 6. The angle B, the angle between the plane of the bottom of the rectangular depressions and the vertical is very nearly 58°.

Figure 6:
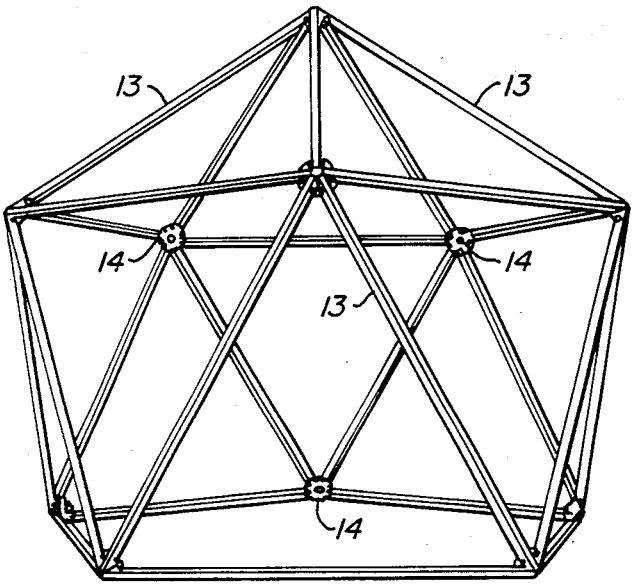
FIG. 6 is a side view of the framework of the geodesic dome showing the struts and connector units in place as they are when the framework is complete.

FIG. 6 is a side view of a completed dome framework showing the manner in which twenty five struts 13 are connected through the use of eleven connecting units 14 of the type described above. The dome framework is a strong, rigid framework and is ready for covering with plywood triangles or plastic or triangles of other materials to make an enclosed dome.

The connector units of the invention are particularly well suited to the needs of a do-it-yourself type builder. Such a builder need only purchase eleven of the connector units described and can buy the lumber which he requires to make the struts. Depending on the character of the use intended by the builder, the struts may range in length from three feet to nine feet and the lumber from which the struts are to be made may be 2×2, 2×4 or 2×6, depending on the size and strength required. Floor area of the dome will range from about 22 square feet when three foot struts are used to about 157 square feet when nine foot struts are used. The lumber employed should be of good quality and not free. The struts, whatever size of dome is desired, must all be of identical length and the builder can make drill holes at each end of each strut, position them about 2 3/16 inches from the strut end and about ¾ of an inch above the surface of the strut which rests on the rectangular depression of a connector unit.

Referring again to FIG. 3, the connector unit is fabricated from steel ranging in gauge size from about 16 to 20 gauge. Where the end use of the dome contemplated by the builder requires exceptional strength and rigidity circular openings 15 along the outer perimeter of the connector unit may be used and either a heavy wood screw inserted into the opening 15 and then into the strut may be used or an additional hole may be bored through the strut to be in register with opening 15 and a bolt run through opening 15 and the strut and tightened with a nut at its top end.

I claim:

1. A connector unit for connecting the struts which form the framework of a geodesic dome comprising:

(a) a sheet metal member having the general shape of a frustum of a right circular cone, (b) five equally spaced rectangular depressions in the outer surface of the frustum and extending between the bases of the frustum, the length sides of the rectangular depressions being parallel to the elements of the frustum, (c) a triangular area lying between each adjacent pair of rectangular depressions, (d) a flange extending outward from each side of each rectangular depression, (e) the plane of each flange being perpendicular to the plane of the related rectangular depression and the flanges on opposite sides of each rectangular depression being in mirror image relation, each flange being formed by opening a portion of the triangular area adjacent the rectangular depression and bending it upward to perpendicular relationship with the plane of the rectangular depression, and (f) an opening in the central area of each flange and the openings in the flanges extending outward from opposite sides of each rectangular depression being in register with each other.

2. A connector defined in claim 1 wherein the angle between the elements of the frustum and the vertical is approximately 67°.

3. A connector defined in claim 2 wherein the angle between the plane of the base of each rectangular depression and the vertical is approximately 58°.

* * * * *